US005240823A

United States Patent [19]

Yamada et al.

[11] Patent Number: 5,240,823

[45] Date of Patent: Aug. 31, 1993

[54] DEVELOPER COMPOSITION

[75] Inventors: Minoru Yamada, Minami-ashigara; Takashi Toyoda, Hadano; Morio Yagihara, Minami-ashigara; Hiroshi Kawamoto, Hadano, all of Japan

[73] Assignee: Fuji Photo Film Co., Ltd., Kanagawa, Japan

[21] Appl. No.: 704,513

[22] Filed: May 23, 1991

[30] Foreign Application Priority Data

May 24, 1990 [JP] Japan ..... 2-134389

[51] Int. Cl.[5] ..... G03C 5/30

[52] U.S. Cl. ..... 430/488; 430/435; 430/438; 430/464; 430/481; 430/485

[58] Field of Search ..... 430/435, 438, 464, 481, 430/485, 488, 966

[56] References Cited

U.S. PATENT DOCUMENTS 4,141,734 2/1979 Lenoir et al. ..... 430/488
4,425,425 1/1984 Abbott et al. ..... 430/502
4,439,520 3/1984 Kofron et al. ..... 430/434

FOREIGN PATENT DOCUMENTS 56-24347 3/1981 Japan .
58-113926 7/1983 Japan .
58-127921 7/1983 Japan .

*Primary Examiner*—Hoa Van Le
*Attorney, Agent, or Firm*—Sughrue, Mion, Zinn, Macpeak & Seas

[57] ABSTRACT

A developer composition comprising a dihydroxybenzene developing agent, a sulfite ion, and an antisludging agent is diluted with water to prepare a developer for the development of photographic silver halide photosensitive material. The components of the composition are divided into a plurality of parts such that the antisludging agent and the dihydroxybenzene developing agent are added to separate parts which are kept apart during storage until they were combined to form the developer.

6 Claims, No Drawings

DEVELOPER COMPOSITION

This invention relates to a developer composition or kit for use in preparing a developer for the development of photographic silver halide photosensitive material, and more particularly, to such a developer composition which can reduce silver contaminant or sludge accumulating on or in developing equipment including a developing tank, rack and rollers during development with the attendant benefit of easy daily maintenance of the equipment.

BACKGROUND OF THE INVENTION

It is well known from the old days that as the development of photographic silver halide photosensitive material (often simply referred to as photosensitive material, hereinafter) is repeated, silver deposits and accumulates on developing equipment including tanks or vats, and developing tank walls, racks and rollers of automatic processors. Such silver deposit is also known as silver contaminant or sludge. Since silver sludge, if left as such, can adhere to a photosensitive material to stain its image, periodic washing and maintenance of the developing equipment is necessary.

There is an increasing demand for quick processing in the development of photographic silver halide photosensitive material. The feasibility of quick processing is enhanced by increasing the activity of developer on one hand, but is largely governed by the nature of photosensitive material. Automatic developing machines or processors generally involve development, fixation, washing and drying steps, and among others, the drying step is a key for quick processing. In order to complete drying as fast as possible, it is most effective to reduce the silver quantity of photosensitive material.

Since plate-shaped silver halide grains have a high covering power, the silver quantity can be reduced without impairing photographic properties and image quality. A reduced silver quantity is advantageous not only for the drying step, but also for quickening development, fixation and washing steps. Therefore, the use of plate-shaped silver halide grains is most suitable for quick processing. The nature of plate-shaped silver halide grains is described in Research Disclosure, Vol. 225, Item 22534, pages 20–58 (January 1983), Japanese Patent Application Kokai (JP-A) Nos. 127921/1983 and 113926/1983, and U.S. Pat. No. 4,425,425.

Nevertheless, since the plate-shaped silver halide grains have an extremely larger surface area than conventional potato like grains, more silver halide is dissolved out to deposit more silver sludge during development than with the potato like grains. Then the advantage of plate-shaped silver halide grains for quick processing is not utilized to a full extent.

In some less sensitive photosensitive materials, such as printing photosensitive materials which need not have high sensitivity in nature and laser printer photosensitive materials which need not have high sensitivity by virtue of systematic electronic cooperation, silver halide grains are used having a smaller size and readily soluble silver bromide or chloride rather than silver iodide so that silver sludging is more likely to occur, although this construction can accommodate quick development irrespective of single side photosensitive material. The silver sludge problem is serious with industrial X-ray photosensitive materials since they bear an amount of silver coated nearly three times the silver coating amount of medical X-ray photosensitive materials and the silver halide grains used are of smaller size.

Further, silver sludge is also a serious problem in the processing of versatile picture-taking negative photosensitive materials since the sulfite concentration of the developer is increased and the developing time is made rather longer in order for solution physical development phenomenon to make a larger contribution to the graininess of images.

As mentioned above, the silver sludge problem is inevitable and has been left unsolved in all types of photo-sensitive material processing systems.

The environmental problem is also of greater concern these days. The disposal of used developer is not an exception. For environmental protection, it is very important and desirable to reduce the amount of replenisher as well as the amount of used developer. However, if the amount of replenisher is reduced, the concentration of silver dissolved into the developer is increased in counter proportion thereto, resulting in more silver sludge. The amount of used developer can be reduced often at the sacrifice of photographic capability because optimum control of the automatic processor is cumbersome. With these problems, it is not easy at present to reduce the amount of replenisher.

Washing to remove silver sludge is generally carried out by emptying the developing tank of the developer, filling the tank with a solution of a strong oxidizing agent such as cerium sulfate, and holding the oxidizing solution in the tank for about ten minutes to about 30 minutes or longer with stirring. Then the developing tank should be thoroughly washed with water because a trace of the oxidizing agent, if left in the developing tank, would oxidize and deteriorate the developer. This washing operation is one of the daily maintenance burdens of an automatic processor. Therefore, it is desired to overcome the problem in view of the safety of operation and the additional pollution by the washing solution.

One approach for reducing silver sludge is by adding a mercapto compound as an antisludging agent for decreasing silver ions dissolving in a developer and/or suppressing reduction of silver ions to silver as disclosed in JP-A 24347/1981 (JP-B 4702/1987). The mercapto compound used is a mercaptobenzimidazole compound having a sulfonic acid group or a salt thereof as a water soluble group.

This approach is accompanied by an inevitable function of suppressing development itself with the attendant drawback of sensitivity lowering. Since photosensitive materials have different sensitivity to the mercapto compound, no consistent effect is achieved simply by adding a fixed amount of the mercapto compound. The sensitivity lowering is a serious drawback in the photosensitive material developing system which is designed for processing with as high sensitivity as possible. A variation in gradation is also a problem to be avoided.

SUMMARY OF THE INVENTION

Therefore, an object of the present invention is to provide a novel and improved developer composition for use in preparing a developer for photographic silver halide photosensitive material which has overcome the drawbacks of the prior art. Another object is to provide such a developer composition which is effective in reducing silver contamination and capable of reducing silver sludge occurring in a developing tank or on developing racks and rollers. A further object is to provide such a developer composition which allows for easy maintenance of an automatic processor or developing equipment. A further object is to provide such a developer composition which can reduce silver sludge without adversely affecting photographic properties. Another object is to provide such a developer composition which can reduce silver sludge without impairing the stability of the developer. A still further object is to provide such a developer composition which can reduce silver sludge while reducing the amount of replenisher.

According to the present invention, the above and other objects are achieved by a developer composition for preparing a developer for the development of photographic silver halide photosensitive material, comprising at least a dihydroxybenzene developing agent, a sulfite ion, and an antisludging agent selected from the group consisting of compounds (A), (B), and (C). The composition is divided into a plurality of parts such that the parts may be combined together to form the developer. The dihydroxybenzene developing agent and the antisludging agent are contained in separate parts. Compounds (A), (B) and (C) forming the antisludging agents are as defined below.

(A) thioctic acid or a salt thereof.

(B) a compound of general formula (I):

$$(A_2)_m\text{-}B_1\text{-}S\text{-}(S)_p\text{-}D_1\text{-}(E_2)_n \qquad (I)$$

wherein $B_1$ and $D_1$ are independently selected from the group consisting of an aliphatic hydrocarbon radical, an alicyclic hydrocarbon radical, an aromatic hydrocarbon radical, and a heterocyclic radical, $A_2$ and $E_2$ are independently selected from the group consisting of

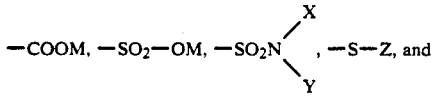

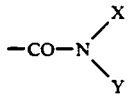

wherein M is a monovalent cation, X is hydrogen or an alkyl radical, Y is selected from the group consisting of hydrogen, alkyl, phenylsulfonate, alkylsulfonyl, and phenylsulfonyl radicals, Z is selected from the group consisting of alkyl, phenylsulfonate, alkylsulfonyl, and phenylsulfonyl radicals, m and n each are equal to 1, 2 or 3, p is equal to 1 or 2, with the proviso that $B_1$ and $D_1$ are free of an α-amino radical when at least one of $A_2$ and $E_2$ is a radical represented by —COOM, or a salt thereof.

(C) a combination of (y1) and (y2).

(y1) a compound of general formula (II) or a salt thereof.

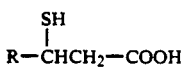

(II)

wherein R is a phenyl or alkyl radical.

(y2) a compound or general formula (III), an aminoalkanethiosulfonic acid or a salt thereof.

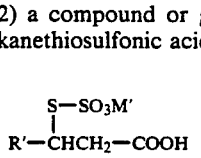

(III)

wherein R' is a phenyl or alkyl radical and M' is a hydrogen atom or alkali metal.

The developer composition of the invention is comprised of a plurality of parts which are to be combined together to prepare a developer. The composition uses an antisludging agent in the form of (A) a thioctic or lipoic acid compound, (B) a compound having a disulfide bond represented by formula (I), or (C) a combination of a mercapto compound having a carboxyl radical represented by formula (II) with a compound having a thiosulfonic acid radical or salt thereof represented by formula (III), or a mixture thereof. Since the antisludging agent is added to a part substantially free of the dihydroxybenzene developing agent, little or no interaction occurs therebetween. The antisludging agent and the developing agent are kept stable in separate parts in the composition during storage from immediately after preparation of the composition to immediately before use. The parts are combined together to prepare a developer in which the antisludging agent is fully effective for preventing silver contamination.

Silver contamination occurs because a sulfite salt in a developer causes a silver halide to be dissolved out of the photosensitive material in the form of a silver sulfite ion which is reduced into silver by the action of the developer. In such a process, each of compounds (A) to (C) has a terminal $S^-$ ion (mercapto ion) or terminal $SSO_3^-$ ion (Bunte salt) created in the developer. More particularly, thioctic acid (A) opens its dithiolan ring in the presence of a sulfite ion in the developer so that its two S atoms are present as a terminal mercapto ion and a terminal Bunte salt. In the case of compound (B), its disulfide bond (S-S) undergoes cleavage in the presence of a sulfite ion to dissociate into a terminal mercapto ion and a terminal Bunte salt in equilibrium. The copresence of a terminal mercapto ion and a terminal Bunte salt also occurs with compound (C).

Among the two terminal ions, the mercapto ion has a high silver coordinating capability to undergo complexing reaction or ligand exchange reaction with silver to form a stable complex compound, either prior or subsequent to the bonding of a sulfite ion with silver. Formation of this complex compound suppresses formation of a silver sulfite ion which causes silver sludge, thus preventing silver sludging.

If the antisludging agent is copresent with a dihydroxybenzene developing agent during storage, however, a sulfite ion resulting from a sulfite salt added as a preservative for the developing agent and the developing agent in semi-quinone or quinone form resulting from partial air oxidation reduce the proportion of a mercapto ion having high silver coordinating capability, disrupting the equilibrium between the compounds involved in the antisludging mechanism mentioned above. If a part containing both the antisludging agent and the developing agent is used to prepare a developer, silver sludging cannot be fully alleviated.

For this reason, the present invention solves the problem by separating the dihydroxybenzene developing agent and compound (A), (B) or (C) and storing them as separate parts. The inventors have first discovered that a loss of the silver contamination preventing capability of compound (A), (B) or (C), that is, antisludging agent is caused by the copresence of the dihydroxybenzene developing agent. A developer system which is divided into a plurality of parts cannot retain the silver contamination preventing capability of the antisludging agent in a way other than the present invention. This fact is unexpected prior to the present invention. The developer system of the present invention provides a satisfactory level of photographic capability.

Some related references are discussed.

U.S. Pat. No. 3,318,701 discloses to add a thioctic acid compound to a developing/fixing monobath to prevent silver sludging in such process. The present invention is discriminated from this U.S. patent in that the present invention is applied to the developer used in a developing step separate from a fixing step.

JP-A 209455/1987 discloses a developer having a thioctic acid compound added thereto. Although the addition of a thioctic acid compound to a developer is disclosed, it is not described that the developer is prepared from a developing kit comprising a plurality of parts and that the thioctic acid should be added to a part free of a dihydroxybenzene developing agent. In fact, the inventors stored a mixture of a dihydroxybenzene developing agent and a thioctic acid compound according to the teaching of JP-A 209455/1987 for some reasonable duration and processed a film therewith to find that no satisfactory antisludging could be achieved. It is to be noted that 1,2-dithiolan-3-valeric acid is identical with thioctic acid.

Further, JP-B 46585/1981 discloses to use a disulfide compound having a carboxyl or sulfonic acid radical falling within the scope of formula (I) as defined herein as an antisludging agent in a developer. It is not described that the developer is prepared from a developing kit comprising a plurality of parts and that the antisludging agent should be added to a part free of a dihydroxybenzene developing agent. In fact, no satisfactory antisludging could be achieved when processed according to the teaching of this publication.

Therefore, the compounds defined as the antisludging agent in the present invention should be added to a part substantially free of a dihydroxybenzene developing agent among parts constituting a developer composition and stored as the separate part before the part is combined with the other parts to prepare a developer, with which development can be carried out without substantial silver sludging.

DETAILED DESCRIPTION OF THE INVENTION

The construction of the present invention is described in further detail.

The developer composition or developing kit of the present invention is adapted to prepare a developer therefrom for use in the development of photographic silver halide photosensitive materials. The developer composition is comprised of a plurality of parts. According to the present invention, at least one compound selected from the group consisting of compounds (A), (B) and (C) is added to a part substantially free from a dihydroxybenzene developing agent.

The part substantially free from a dihydroxybenzene developing agent should contain up to 50 grams/liter of a dihydroxybenzene developing agent in a concentrated liquid form, and preferably be completely free from a dihydroxybenzene developing agent. Preferably, the part has neutral or low pH, that is, pH 7 or lower.

(A) Thioctic acid compounds

Thioctic acid is also known as lipoic acid, α-lipoic acid or 6,8-dithiooctanoic acid and may take d, l or dl form. In addition to thioctic acid, its salts are also useful. Exemplary are thioctic acid salts of alkali metals such as sodium and potassium and ammonium salts.

(B) Compounds of general formula (I)

$$(A_2)_m\text{-}B_1\text{-}S\text{-}(S)_p\text{-}D_1\text{-}(E_2)_n \qquad \text{(I)}$$

In formula (I), $B_1$ and $D_1$ each are an aliphatic hydrocarbon radical, an alicyclic hydrocarbon radical, an aromatic hydrocarbon radical or a heterocyclic radical. The heterocyclic radical has a five- or six-membered hetero ring which may be condensed and contains 1 to 3 nitrogen atoms, one oxygen atom or one sulfur atom. The heterocyclic radical may have a substituent such as amino.

$A_2$ and $E_2$ each are $$-COOM,\ -SO_2-OM,\ -SO_2N\begin{matrix}X\\Y\end{matrix},\ -S-Z,\ \text{or}$$

$$-CO-N\begin{matrix}X\\Y\end{matrix}.$$

In these formulae, M is a monovalent cation, X is hydrogen or an alkyl radical, Y is selected from the group consisting of hydrogen, alkyl, phenylsulfonate, alkylsulfonyl, and phenylsulfonyl radicals, and Z is selected from the group consisting of alkyl, phenylsulfonate, alkylsulfonyl, and phenylsulfonyl radicals. The alkyl radicals represented by X, Y and Z are preferably alkyl radicals having up to 8 carbon atoms which may have a substituent such as a carboxylic or sulfonic acid radical. The alkylsulfonyl radicals represented by Y and Z are preferably lower alkylsulfonyl radicals having 1 to 5 carbon atoms.

In formula (I), letters m and n each are equal to 1, 2 or 3, and p is equal to 1 or 2.

It is provided that $B_1$ and $D_1$ are free of an α-amino radical when at least one of $A_2$ and $E_2$ is a radical represented by —COOM.

(C) Combinations of (y1) and (y2)

(y1) a compound of general formula (II)

$$R-\underset{}{\overset{SH}{\overset{|}{C}}}HCH_2-COOH \qquad \text{(II)}$$

In formula (II), R is a phenyl or alkyl radical, preferably having 1 to 5 carbon atoms, such as methyl, ethyl and propyl.

(y2) a compound or general formula (III) and/or an aminoalkanethiosulfonic acid compound $$R'-\overset{S-SO_3M'}{\overset{|}{C}}HCH_2-COOH \qquad \text{(III)}$$

In formula (III), R′ is a phenyl or alkyl radical, preferably having 1 to 5 carbon atoms, such as methyl, ethyl and propyl, and M′ is a hydrogen atom or alkali metal.

The aminoalkanethiosulfonic acid compounds include aminoalkanethiosulfonic acids in which the alkane is preferably lower alkane having 1 to 5 carbon atoms, for example, aminoethylthiosulfonic acid, and alkali metal salts thereof.

Preferred among the compounds of formula (I) are those of general formulae (IV) and (V).

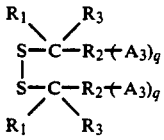

(IV)

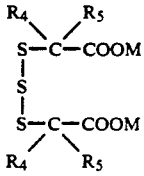

(V)

In formula (IV), $R_1$ and $R_3$ each are hydrogen, a substituted or unsubstituted alkyl radical having 1 to 6 carbon atom, alkenyl radical, aralkyl radical, cycloalkyl radical, substituted or unsubstituted phenyl radical, 5- or 6-membered heterocyclic radical containing 1 to 3 nitrogen atoms, one oxygen atom or one sulfur atom, or carboxyl radical; $R_2$ may be a valence bond or substituted or unsubstituted alkylene radical, alkylidene radical, phenylene radical, aralkylene radical or $-CONHCH_2$; $A_3$ is —COOM or $—SO_3M$ wherein M is as defined in formula (I); and letter q is equal to 1 or 2.

In formula (V), $R_4$ and $R_5$ each are hydrogen or a methyl radical.

M is preferably a proton or alkali metal cation such as $Na^+$ and $K^+$.

More preferred among the compounds of formula (IV) are those of formula (VI).

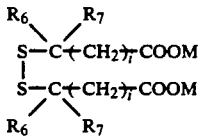

(VI)

In formula (VI), $R_6$ and $R_7$ each are hydrogen, a substituted or unsubstituted alkyl radical (e.g., $—CH_3$, $—C_2H_5$, $—CH_2OH$, and $—CH_2COOH$), cycloalkyl radical (e.g., cyclopentyl and cyclohexyl), substituted or unsubstituted phenyl radical (e.g., phenyl, tolyl, p-chlorophenyl, p-aminophenyl, p-sulfophenyl, and p-sulfonamidephenyl), 5- or 6-membered heterocyclic radical containing 1 to 3 nitrogen atoms, one oxygen atom or one sulfur atom (e.g., furyl and thienyl), or carboxyl radical. Letter l is equal to 1, 2, 3 or 4. M is as defined in formula (I).

Illustrative, but non-limiting examples of the compounds of formula (I) are given below.

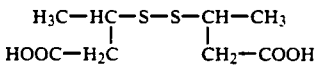

(I-1)

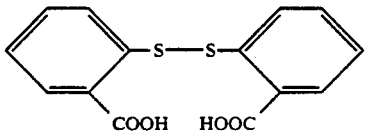

(I-2)

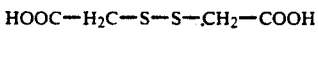

(I-3)

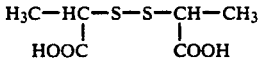

(I-4)

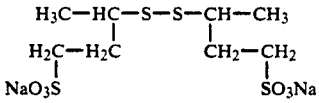

(I-5)

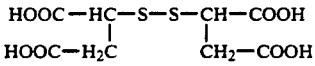

(I-6)

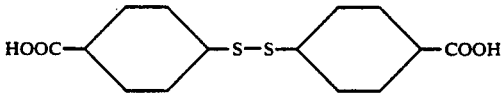

(I-7)

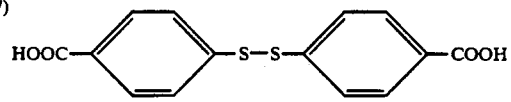

(I-8)

$HOOC(CH_2)_2—S—S—(CH_2)_2COOH$ (I-9)

$HOOC(CH_2)_3—S—S—(CH_2)_3COOH$ (I-10)

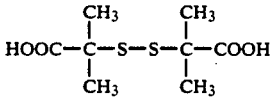

(I-11)

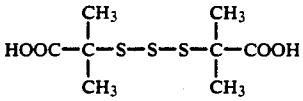

(I-12)

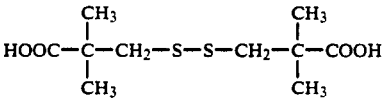

(I-13)

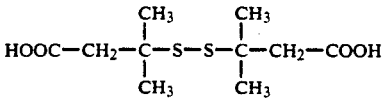

(I-14)

-continued
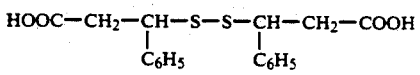
(I-15)
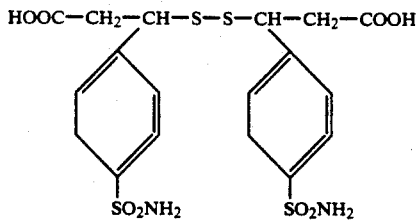
(I-16)
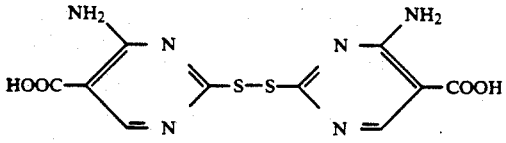
(I-17)
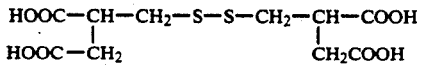
(I-18)
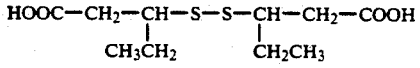
(I-19)
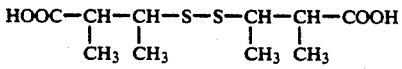
(I-20)
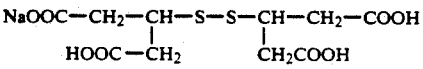
(I-21)
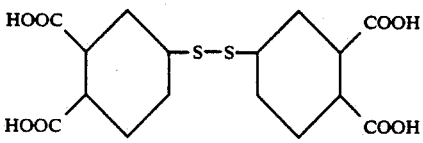
(I-22)
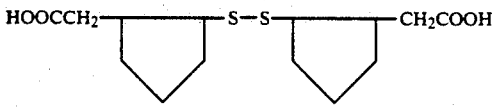
(I-23)
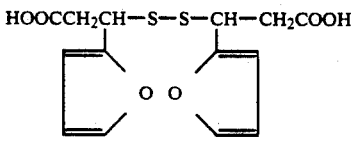
(I-24)
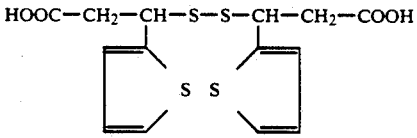
(I-25)
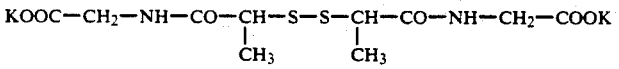
(I-26)
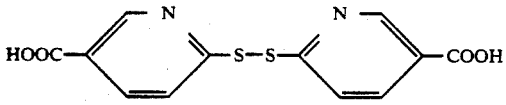
(I-27)
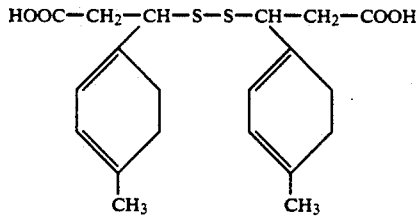
(I-28)
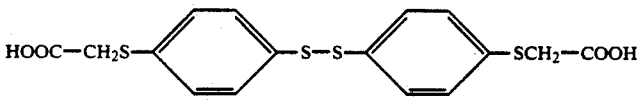
(I-29)
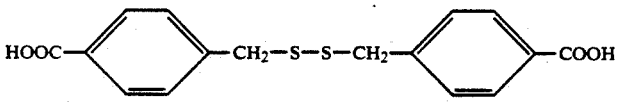
(I-30)
(I-31)
Illustrative, but non-limiting examples of the compounds of formulae (II) and (III) are given below.
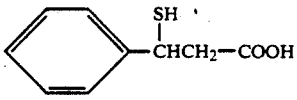
(II-1)

-continued

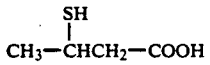

(II-2)

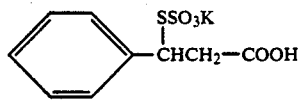

(III-1)

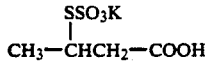

(III-2)

Compounds (A), (B) and (C) may be used alone or in admixture of any two or more. A mixture of compounds of the same type and a mixture of compounds of different types are useful. Preferred in the practice of the invention is the use of compounds (A) and (B).

Thioctic acid is most preferred among compounds (A).

Most preferred among compounds (B) are compounds (I-15), (I-16), (I 17), (I-24), (I-25), (I-27), (I 28), and (I-30) illustrated above.

Most preferred among combinations (C) is a combination of (II-1) and (III-1).

The antisludging agent (A), (B) or (C) is preferably used in an amount to provide a developer having a concentration of 0.01 to 20 grams/liter, more preferably 0.05 to 5 grams/liter of the agent. When a mixture of agents is used, the total amount should meet this range. In the case of combination (C), compounds (yl) and (y2) are preferably combined in a molar ratio of from 100:1 to 1:100, especially from 5:1 to 1:20.

Thioctic acid compounds may be synthesized by well-known methods and naturally occurring ones are also useful. Compounds of general formulae (I), (II) and (III) may be synthesized by such methods as disclosed in JP-B 46585/1981 and 28459/1987.

The developer composition or developing kit of the present invention is comprised of a plurality of parts, typically two or three parts.

Most often, the two-part system is a composition consisting of an alkaline part containing a dihydroxybenzene developing agent and another part containing a hardener, especially dialdehyde hardener. The three-part system is a composition consisting of a first part containing a dihydroxybenzene developing agent, a second part containing an auxiliary developing agent, and a third part containing a hardener.

Consequently, agent (A), (B) or (C) is added to the part containing a hardener in the two-part system. The agent is added to the second part containing an auxiliary developing agent or the third part containing a hardener in the three-part system. Alternatively, it may be added in divided portions to both the second and third parts of the three-part system. The part to which agent (A), (B) or (C) is added is typically an acidic part having pH 7 to 1, preferably pH 6 to 2.

The agent (A), (B) or (C) is preferably added to the part in an amount to provide a developer having a (total) concentration of 0.01 to 20 grams/liter, more preferably 0.05 to 5 grams/liter of the agent or agents as previously mentioned.

The agent (A), (B) or (C) is kept stable or intact during storage, that is, for a duration from the preparation of a developing kit to actual use by the user because no interaction can occur between the agent and the dihydroxybenzene developing agent. The part containing agent (A), (B) or (C) is combined with the other part or parts and diluted with water to prepare a developer which is not only effective for development, but also for preventing silver sludging.

Most often, the part to which the developing agent is added is an alkaline part containing a sulfite preservative. If agent (A), (B) or (C) is added to such an alkaline part, an oxidant form of the developing agent combined with a sulfite ion interacts with agent (A), (B) or (C) to lower its antisludging capability, failing to achieve the desired effect.

During use of a developer, agent (A), (B) or (C) is copresent with the dihydroxybenzene developing agent in the developer. In the developer solution, however, the loss of the capability of agent (A), (B) or (C) is negligible in a substantial sense.

The parts of the developer composition of the present invention are combined together and diluted with water to form a black-and-white developer for the development of photosensitive materials. Now, the black-and-white developer resulting from the present composition is described.

The developing agent used in the black-and-white developer is mainly a dihydroxybenzene or hydroquinone developing agent while combinations of a hydroquinone with a 1-pheny-3-pyrazolidone or p-aminophenol are preferred for better performance.

Examples of the hydroquinone developing agent include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred.

Examples of the p-aminophenol developing agent include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with the N-methyl-p-aminophenol being preferred.

Examples of the 3-pyrazolidone developing agent include 1-phenyl-3-pyrazolidone, 1-phenyl-4,4-dimethyl-3-pyrazolidone, 1-phenyl-4-methyl4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The hydroquinone developing agent is generally used in an amount of 0.01 to 1.5 mol/liter, preferably 0.05 to 1.2 mol/liter. In addition to the hydroquinone developing agent, the p-aminophenyl or 3-pyrazolidone developing agent is generally used in an amount of 0.0005 to 0.2 mol/liter, preferably 0.001 to 0.1 mol/liter.

The sulfite preservatives in the black-and-white developer according to the present invention include sodium sulfite, potassium sulfite, lithium sulfite, ammonium sulfite, sodium bisulfite, and potassium metabisulfite. The sulfite is generally used in an amount of at least 0.2 mol/liter, preferably from 0.4 to 2.5 mol/liter. A developer containing a sulfite is prone to silver sludging, against which the present invention is effective.

The black-and-white developer is preferably at pH 8.5 to 13, more preferably pH 9 to 12.

For adjusting the pH of the developer to such a level, an alkaline agent is used. Included are pH adjusting agents such as sodium hydroxide, potassium hydroxide, sodium carbonate, potassium carbonate, sodium tertiary phosphate, and potassium tertiary phosphate. Also useful are buffer agents, for example, borates as disclosed in JP-A 186259/1987, saccharose, acetoxime and 5-sulfosalicylate as disclosed in JP-A 93433/1985, phosphates, and carbonates.

Also used in the developer is a dialdehyde hardener or a bisulfite salt adduct thereof, for example, glutaraldehyde or a bisulfate salt adduct thereof.

Other additives used in the developer include a development retarder such as sodium bromide, potassium bromide, and potassium iodide; an organic solvent such as ethylene glycol, diethylene glycol, triethylene glycol, dimethylformamide, methyl cellosolve, hexylene glycol, ethanol, and methanol; and an antifoggant, for example, mercapto compounds such as 1-phenyl-5-mercaptotetrazole and sodium 2-mercaptobenzimidazole-5-sulfonate, indazole compounds such as 5-nitroindazole, and benzotriazole compounds such as 5-methylbenzotriazole. Also added to the black-and-white developer according to the present invention are a development promoter as disclosed in Research Disclosure, Vol. 176, No. 17643, Item XXI (December 1978), and if desired, a color toning agent, a surface-active agent, a debubbling agent, a water softener, and an amino compound such as alkanol amine as disclosed in JP-A 106244/1981 and EP 0136582.

The above-described development is followed by fixation. Fixation uses a fixer which is an aqueous solution containing a thiosulfate at pH 3.8 or higher, preferably pH 4.2 to 7.0.

The fixing agents include sodium thiosulfate and ammonium thiosulfate although the ammonium thiosulfate is preferred for fixing rate. The fixing agent is added in a varying amount, generally from about 0.1 to 3 mol/-liter.

Also added to the fixer is a hardener including water soluble aluminum salts, for example, aluminum chloride, aluminum sulfate, and potassium alum. The fixer may contain tartaric acid, citric acid, gluconic acid or derivatives thereof alone or in admixture of two or more in an amount of at least 0.005 mol/liter, preferably 0.01 to 0.03 mol/liter. If desired, the fixer may further contain preservatives (e.g., sulfites and bisulfites), pH buffer agents (e.g., acetic acid and boric acid), pH adjusting agents (e.g., sulfuric acid), chelating agents having an ability to soften hard water, and the compounds disclosed in JP-A 78551/1987.

After development and fixation, the photosensitive material is to be processed with wash water or stabilizer which is replenished at a flow rate of up to 3 liters per square meter of the photosensitive material (inclusive of 0, that is, pool water washing).

One way of reducing the replenisher amount is a multi-stage (e.g., 2 or 3 stage) counterflow mode as is well known from the old days. With the multi-stage counterflow mode, the photosensitive material after fixation is washed successively in a gradually cleaner direction, that is, with cleaner solutions contaminated with a less amount of the fixer, resulting in more efficient washing.

In the case of water-saving washing or non-piping washing, wash water or stabilizer should preferably be provided with antifungal means. The antifungal means include UV radiation as disclosed in JP-A 26393/1985, a magnetic field as disclosed in 263940/1985, the use of an ion exchange resin to produce pure water as disclosed JP-A 131632/1986, ozone blowing, and the use of antibacterial agents as disclosed in JP-A 51396/1986, 63030/1986, 115154/1987, 153952/1987, and 91533/1989. Also useful is combined use of biocidal agents, antifungal agents and surface active agents as disclosed in L.F. West, "Water Quality Criteria", Photo. Sci. & Eng., Vol. 9, No. 6(1965), M.W. Beach, "Microbiological Growths in Motion-Picture Processing", SMPTE Journal, Vol. 85 (1976), R.O. Deegan, "Photo Processing Wash Water Biocides", J. Imaging Tech., 10, No. 6(1984), and JP-A 8542/1982, 58143/1982, 97530/1982, 132146/1982, 157244/1982, 18631/1983, and 105145/1983.

The wash water or stabilizer bath may additionally contain microbiocides, for example, the isothiazoline compounds as described in R.T. Kreiman, J. Image Tech., 10, 6 (1984), page 242, Research Disclosure, Vol. 205, No. 20526 (May 1981), and ibid., Vol. 228, No. 22845 (April 1983); and the compounds described in Japanese Patent Application No. 51396/1986. Also useful are compounds as described in H. Horiguchi, "Bokin Bobai No Kagaku (Chemistry of Antifungal and Biocidal Agents)", Sankyo Publishing K.K. (1982) and "Bokin Bobai Gijutu Handbook (Antifungal and Biocidal Technical Handbook)", Japan Antifungal and Biocidal Associate, Hakuhodo K.K. (1986).

When washing with a small amount of water, a squeeze roller wash tank is preferably used as disclosed in JP-A 18350/1988. A washing procedure as disclosed in JP-A 143548/1988 is also preferred.

As water having antifungal means applied thereto is replenished to a washing or stabilizing tank in proportion to the processing quantity, an overflow exits the tank. It is possible to utilize part or all of the overflow as a processing solution having a fixing function in the preceding step.

Several terms are defined in conjunction with a sequence of successively processing a length of photosensitive material through a developing tank, a fixing tank, a washing tank, and then a drying section of an automatic processor. "Developing time" is a duration taken from the point when the leading edge of a length of photosensitive material is dipped in a developer in the developing tank to the point when it is dipped in a fixer in the fixing tank. "Fixing time" is a duration taken from the point when the leading edge is dipped in the fixer to the point when it is dipped in wash water or stabilizer in the washing tank. "Washing time" is a duration when the photosensitive material is dipped in the wash tank liquid. "Drying time" is a duration when the photosensitive material passes through the processor drying section which is usually designed to blow hot air at a temperature of 35° to 100° C., preferably 40° to 80° C.

In development, the developing time generally ranges from 5 seconds to 3 minutes, preferably from 8 seconds to 2 minutes while the temperature ranges from 18° to 50° C., preferably from 20° to 40° C.

In fixation, the fixing time generally ranges from 5 seconds to 3 minutes at a temperature of about 18° to 50° C., preferably from 6 seconds to 2 minutes at a temperature of about 20° to 40° C.

In water washing, the washing time generally ranges from 6 seconds to 3 minutes at a temperature of about 0° to 50° C., preferably from 6 seconds to 2 minutes at a temperature of about 10° to 40° C.

Having finished development, fixation and washing (or stabilization), the photosensitive material is removed of the wash water, that is, squeezed of water through squeeze rollers and then dried. Drying is generally at about 40° to 100° C. The drying time may vary with the ambient condition, usually in the range of from 5 seconds to 3 minutes, preferably from 5 seconds to 2 minutes at 40° to 80° C.

In carrying out development process within 100 seconds on a dry-to-dry basis in a photosensitive material processing system as mentioned above, it is recommended to provide the developing tank at the outlet with rollers of rubbery material for reducing a development variation inherent to quick processing as disclosed in JP-A 151943/1988, to circulate the developer at a flow rate of 10 m/min. or higher in the developing tank for agitating the developer as disclosed in JP-A 151944/1988, and to effect more intense agitation during processing periods than during standby periods as disclosed in JP-A 264758/1988. For quick processing, rollers are preferably arranged in the fixing tank in an opposed fashion in order to increase the fixing rate. The opposed roller arrangement reduces the number of rollers used and the volume of the fixing tank. The processor becomes more compact.

The photosensitive materials to which the developer composition of the present invention is applicable are mainly general black-and-white photosensitive materials, for example, ordinary picture taking negative films and black-and-white print papers, laser printer photographic materials and printing photosensitive materials for recording medical images, medical direct radiographic photosensitive materials, medical photofluorographic photosensitive materials, photosensitive materials for recording CRT display images, and industrial X-ray photosensitive materials.

The photosensitive materials to which the present invention is applicable bear thereon a photographic emulsion containing silver halide grains which may be regular grains having regular crystallographic form such as cubic, octahedral and tetradecanohedral (14-sided), grains of irregular crystallographic form such as spherical, grains having crystal defects such as twin plane, plate-shaped grains or a mixture thereof.

As described in the preamble, plate-shaped silver halide grains are advantageous. The plate-shaped grains have an aspect ratio which is defined as a ratio of an average diameter of a circle having an equal area to the projected area of individual grains to an average thickness of individual grains. Preferably the plate-shaped grains have an aspect ratio of from 4 to less than 20, more preferably from 5 to less than 10 while the thickness is preferably up to 0.3 μm, especially up to 0.2 μm. Preferably the plate-shaped grains are present in an amount of at least 80% by weight, more preferably at least 90% by wight of the total weight of silver halide grains.

Silver sludging often occurs when a photosensitive material using plate-shaped grains is subject to development since the plate-shaped grains are well soluble. The present invention is intended to prevent such silver sludging. More silver sludging occurs with plate-shaped grains of a composition based on silver chloride or bromide (while the silver iodide content is up to 0.5 mol%) since these grains are more soluble. The present invention is effective to prevent such heavy silver sludging.

The silver halide grains may form a monodispersed emulsion having a narrow distribution of grain size or a polydispersed emulsion having a wide distribution of grain size.

The photographic silver halide emulsion used herein may be prepared by well-known methods, for example, as described in Research Disclosure, No. 17643 (December 1978), pages 22–23, "I. Emulsion preparation and types" and ibid., No. 18716 (November 1979), page 648. Other applicable emulsion preparing methods are described in the literature, for example, Glafkides, Chemie et Physique Photographique, Paul Montel, 1967; G.F. Duffin, Photographic Emulsion Chemistry, Focal Press, 1966; and V.L. Zelikman et al, Making and Coating Photographic Emulsion, Focal Press, 1964.

For controlling the growth of silver halide grains during their formation, there may be used an agent for solubilizing silver halide, for example, ammonia, potassium thiocyanate, ammonium thiocyanate, and thioethers as disclosed in U.S. Pat. Nos. 3,271,157, 3,574,628, 3,704,130, 4,297,439, and 4,276,374; thion compounds as disclosed in JP-A 144319/1978, 82408/1978, and 77737/1980, and amine compounds as disclosed in JP-A 100717/1979. Water soluble rhodium and iridium salts of these compounds are also useful.

The mode of reaction of a soluble silver salt with a soluble halide salt may be single jet mixing, double jet mixing, and a combination thereof. Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

The silver halide emulsion may be chemically sensitized, for example, by conventional sulfur sensitization, reducing sensitization, noble metal sensitization and a combination thereof. Useful chemical sensitizers include sulfur sensitizers such as allyl thiocarbamide, thioureas, thiosulfates, thioethers and cystine; noble metal sensitizers such as potassium chloroaurate, aurous thiosulfate and potassium chloropalladate; and reducing sensitizers such as phenylhydrazine and reductone.

The silver halides used herein may be spectrally sensitized with well known spectral sensitizing dyes if desired. The dyes useful for spectral sensitization include cyanine dyes, merocyanine dyes, rhodacyanine dyes, styryl dyes, hemicyanine dyes, oxonol dyes, benzylidene dyes, and holopolar dyes as described in F.M. Hamer, "Heterocyclic Compounds-The Cyanine Dyes and Related Compounds", John Wiley & Sons (1964) and D.M. Sturner, "Heterocyclic Compounds-Special Topics in Heterocyclic Chemistry", John Wiley & Sons (1977), with the cyanine and merocyanine dyes being preferred.

Preferred examples of the sensitizing dye include cyanine and merocyanine dyes of the general formulae defined in JP-A 122928/1975, 212827/1984, 1801553/1984, 133442/1985, 75339/1986, and 6251/1987, more specifically, sensitizing dyes capable of spectral sensitization of silver halides in blue, green, red or infrared spectra set forth in pages 7–9 of JP-A 122928/1975, pages 5–7 of JP-A 212827/1984, pages 7–18 of JP-A 1801553/1984, pages 8–11 of JP-A 133442/1985, pages 5–7 and 24–25 of JP-A 75339/1986, and pages 10–15 of JP-A 6251/1987.

The sensitizing dyes may be used alone or in combination. Combinations of sensitizing dyes are often used particularly for the purpose of supersensitization.

Along with the sensitizing dyes, the emulsions may contain dyes which themselves have no spectral sensitization effect or substances which do not substantially absorb visible light, but have the nature of supersensitization. Useful are aminostyryl compounds having a nitrogenous heterocyclic substituent as described in U.S. Pat. Nos. 2,933,390 and 3,635,721, aromatic organic acid-formaldehyde condensates as described in U.S. Pat. No. 3,743,510, cadmium salts and azaindenes. Especially useful combinations are described in U.S. Pat. No. 3,615,613, 3,615,641, 3,617,295, and 3,635,721.

The sensitizing dye is preferably used in an amount of $5\times10^{-7}$ to $5\times10^{-2}$ mol, more preferably $1\times10^{-6}$ to $1\times10^{-3}$ mol, most preferably $2\times10^{-6}$ to $5\times10^{-4}$ mol per mol of silver halide in the photographic silver halide emulsion.

The sensitizing dye can be directly dispersed in the emulsion layer. Alternatively, the sensitizing dye is first dissolved in a suitable solvent such as methyl alcohol, ethyl alcohol, methyl cellosolve, acetone, water, pyridine or a mixture thereof to form a solution which is added to the emulsion. Ultrasonic vibration may assist in dissolving the dye. Further, the sensitizing dye may be added to the emulsion through various procedures, for example, by dissolving the dye in a volatile organic solvent, dispersing the solution in hydrophilic colloid, and adding the dispersion to the emulsion as described in U.S. Pat. No. 3,469,987; by dispersing a water-insoluble dye in a water-soluble solvent and adding the dispersion to the emulsion as described in JP-B 24185/1971; by grinding and dispersing a water-insoluble dye in an aqueous medium and adding the dispersion to the emulsion as disclosed in JP-B 45217/1986; by dissolving a dye in a surface-active agent and adding the solution to the emulsion as disclosed in U.S. Pat. No. 3,822,135; by dissolving a dye in a red-shifting compound and adding the solution to the emulsion as disclosed in JP-A 74624/1976; and by dissolving a dye in a substantially water-free acid and adding the solution to the emulsion as disclosed in JP-A 80826/1975. Alternatively, the dye may be added to the emulsion by such methods as described in U.S. Pat. Nos. 2,912,343, 3,342,605, 2,996,287, and 3,429,835. The sensitizing dye may be uniformly dispersed in the silver halide emulsion at any stage of its preparation or after its preparation, but prior to application to a suitable support, for example, during or prior to chemical sensitization, or prior to, during or subsequent to silver halide grain formation according to the teachings of U.S. Pat. Nos. 4,183,756 and 4,225,666. It is known that when a sensitizing dye is added during or prior to chemical sensitization, or prior to, during or subsequent to silver halide grain formation, the dye is strongly adsorbed to the silver halide. A photosensitive material using a silver halide emulsion prepared in this way is also an objective to which the present invention is applicable.

Another sensitizing dye can be used in combination with any of the above-mentioned sensitizing dyes. Useful sensitizing dyes are disclosed in the following patents.

| | | |
|---|---|---|
| | U.S. Pat. Nos. | |
| 2,615,613 | 2,688,545, | 3,397,060 |
| 3,416,927 | 3,615,632 | 3,615,635 |
| 3,617,295 | 3,628,964 | 3,635,721 |
| 3,703,377 | | |
| | UK Patent Nos. | |
| 1,242,588 | 1,293,862 | |
| JP-B | | |
| 4930/1968 | 4936/1968 | 10773/1968 |
| 14030/1969 | | |

The hardeners which can be used in the emulsions include various organic compounds, for example, aldehydes, compounds having active halogen as described in U.S. Pat. No. 3,288,775, compounds having a reactive ethylenically unsaturated group as described in U.S. Pat. No. 3,635,718, epoxy compounds as described in U.S. Pat. No. 3,091,537, and halogenocarboxyaldehydes such as mucochloric acid. Among others, vinylsulfone hardeners are preferred as well as high polymer hardeners. Preferred high polymer hardeners are polymers having an active vinyl group or a precursor thereof, especially polymers having an active vinyl group or a precursor thereof attached to their backbone through a long spacer as described in JP-A 142524/1981. The amount of the hardener added may be determined so as to provide an adequate swelling factor, depending on the type of gelatin or the like.

In rapid processing, the emulsion layer and/or another hydrophilic colloid layer preferably contains an organic substance which can be dissolved out during development. If this substance is gelatin, gelatin of the type which does not participate in crosslinking reaction of gelatin by the hardener is preferred. Such special type of gelatin includes acetylated gelatins and phthalated gelatins, with ones having a lower molecular weight being preferred. Polymers other than gelatin include polyacrylamide as disclosed in U.S. Pat. No. 3,271,158, hydrophilic polymers such as polyvinyl alcohol and polyvinyl pyrrolidone, and saccharides such as dextran, saccharose and pluran. Preferred are polyacrylamide and dextran, with the polyacrylamide being most preferred. These polymers have an average molecular weight of up to 20,000, more preferably up to 10,000. In addition, antifoggants and stabilizers as disclosed in Research Disclosure, Vol. 176, No. 17643, Item VI (December 1978) may be used.

The present invention is also applicable to the image formation process of photographic silver halide photosensitive materials using hydrazine derivatives capable of providing photographic properties of super high contrast and high sensitivity as disclosed in U.S. Pat. No. 4,166,742, 4,168,977, 4,221,957, 4,224,401, 4,243,739, 4,272,606, and 4,311,781. The hydrazine derivatives are described in Research Disclosure, Item 23516, page 346 (November 1983) and the references cited therein, as well as U.S. Pat. Nos. 4,080,207, 4,269,929, 4,276,364, 4,278,748, 4,385,108, 4,459,347, 4,478,928, and 4,560,638, UK Patent No. 2,011,391B, and JP-A 179734/1985. The hydrazine derivative is preferably added in an amount of $1\times10^{-6}$ to $5\times10^{-2}$ mol, more preferably $1\times10^{-5}$ to $2\times10^{-2}$ mol per mol of silver halide.

In the processing of this special photosensitive material, the developer should preferably contain an amino compound as a contrast enhancer as disclosed in U.S. Pat. No. 4,269,929.

The photosensitive materials to which the present invention is applicable may have a silver coating weight of 0.5 to 25 grams, preferably 0.7 to 20 grams per square meter. In the case of double side coating, this silver coating weight is a total of the double coatings.

The present invention is more effective when processing photosensitive materials which contain silver in a higher coating weight, have a higher content of silver chloride and/or bromide, use silver halide grains of smaller size, and/or require a longer developing time.

EXAMPLE

Examples of the present invention are given below by way of illustration and not by way of limitation. In the examples, Mw is a molecular weight, and whenever reference is made to a sheet of photosensitive material, it is a sheet of 10×12 inch size also known as the quarter size.

EXAMPLE 1

(1) Preparation of plate-shaped grains

Preparation of emulsion

To 1 liter of water were added 5 grams of potassium bromide, 0.05 grams of potassium iodide, 30 grams of gelatin, and 2.5 cc of an aqueous solution of 5% thioether $HO(CH_2)_2S(CH_2)_2S(CH_2)_2OH$. To this solution at 73° C., an aqueous solution containing 8.33 grams of silver nitrate and another aqueous solution containing 5.94 grams of potassium bromide and 0.726 grams of potassium iodide were added over 45 seconds by a double jet mixing method. Then, 2.5 grams of potassium bromide was added and thereafter, an aqueous solution containing 8.33 grams of silver nitrate was added over 26 minutes at an increasing flow rate such that the flow rate at the end of addition was twice the flow rate at the start of addition.

To the resulting solution were added 20 cc of a 25% ammonia solution and 10 cc of 50% $NH_4NO_3$. After 20 minutes of physical ripening, 240 cc of 1N sulfuric acid was added to the solution for neutralization. Subsequently, an aqueous solution containing 153.34 grams of silver nitrate and an aqueous potassium bromide solution were added to the solution over 40 minutes by a controlled double jet method while maintaining the solution potential at pAg 8.2. The flow rate of each solution was increased such that the flow rate at the end of addition was 9 times the flow rate at the start of addition. At the completion of addition, 15 cc of a 2N potassium thiocyanate solution was added and then, 25 cc of an aqueous 1% potassium iodide solution added over 30 seconds. Then, the solution was cooled to a temperature of 35° C. for allowing the soluble salts to be removed by sedimentation. The temperature was raised to 40° C. and 30 grams of gelatin and 2 grams of phenol were added to the emulsion, which was adjusted to pH 6.40 and pAg 8.10 with sodium hydroxide and potassium bromide.

After the temperature was raised to 56° C., there were added 600 mg of a sensitizing dye and 150 mg of a stabilizer having the structures shown below. After 10 minutes, 2.4 mg of sodium thiosulfate pentahydrate, 140 mg of potassium thiocyanate, and 2.1 mg of chloroauric acid were added to the emulsion. After 80 minutes, the emulsion was rapidly cooled into a solid emulsion. In this emulsion, those grains having an aspect ratio of at least 3 occupied 98% of the projected area of the entire grains, and all the grains having an aspect ratio of at least 2 had an average projection area diameter of 1.4 μm with a standard deviation of 22%, an average thickness of 0.187 μm, and an average aspect ratio of 7.5.

Sensitizing dye

-continued

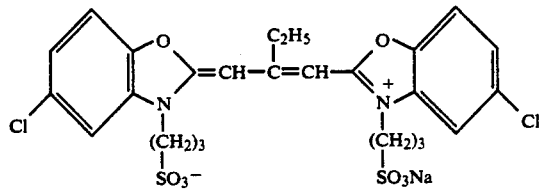

Stabilizer

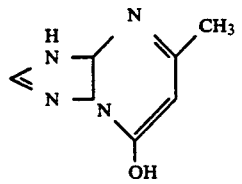

Preparation of emulsion coating composition

A coating composition was prepared by adding the following chemicals to the emulsion in the amounts reported per mol of silver halide.

| | |
|---|---|
| Gelatin | an amount to give an Ag/(gelatin + polymer) weight ratio of 1.10 |
| Water-soluble polyester | 20% by weight based on the gelatin |
| Polymer latex poly(ethylacrylate/methacrylic acid) = 97/3 | 25.0 grams |
| Hardener 1,2-bis(vinylsulfonyl-acetamide)ethane | 8 mmol/100 grams of gelatin in emulsion layer of surface protective layer |
| Phenoxyethanol | 2 grams |
| 2,6-bis(hydroxyamino)-4-diethylamino-1,3,5-triazine | 80 mg |
| Sodium polyacrylate (average Mw = 41,000) | 4.0 grams |
| Potassium polystyrenesulfonate (average Mw = 600,000) | 1.0 grams |

Preparation of photosensitive material A

The emulsion coating composition was coated on a transparent polyethylene terephthalate (PET) support of 175 μm thick along with a surface protective layer coating composition. The amount of silver coated was 3.2 grams/m² in total of the both sides.

The surface protective layer coating composition used had been prepared to form a surface protective layer consisting of the following components in the following coating weight. (n: degree of polymerization)

| Surface protective layer | Coating weight |
|---|---|
| Gelatin | 1.15 g/m² |
| Polyacrylamide (average Mw = 45,000) | 0.25 g/m² |
| Sodium polyacrylate (average Mw = 400,000) | 0.02 g/m² |
| Sodium p-t-octylphenoxydiglyceryl-butylsulfonate | 0.02 g/m² |
| Polyoxyethylene (n = 10) cetyl ether | 0.035 g/m² |
| Polyoxyethylene (n = 10)/polyoxyglyceryl (n = 3) p-octylphenoxy ether | 0.01 g/m² |
| 2-chlorohydroquinone | 0.046 g/m² |
| $C_8F_{17}SO_3K$ | 0.003 g/m² |

-continued

| Surface protective layer | Coating weight |
|---|---|
| $C_8F_{17}SO_2N(C_3H_7)-(CH_2CH_2O)_4-(CH_2)_4-SO_3Na$ | 0.001 g/m² |
| $C_8F_{17}SO_2N(C_3H_7)-(CH_2CH_2O)_{15}-H$ | 0.003 g/m² |
| Proxcel | 0.001 g/m² |
| Polymethyl methacrylate (mean particle size 3.5 μm) | 0.025 g/m² |
| Poly(methyl methacrylate/methacrylate) (molar ratio 7:3, mean particle size 2.5 μm) | 0.020 g/m² |

(2) Preparation of potato-shaped grains

Preparation of emulsion

To 900 cc of water were added 20 grams of gelatin, 30 grams of potassium bromide, and 3.91 grams of potassium iodide. To this solution in a container kept at 48° C., an aqueous solution containing 35 grams of silver nitrate was added over 4 minutes with stirring.

To the solution, ammoniacal silver nitrate (165 grams of silver nitrate) and an aqueous potassium bromide solution were concurrently added over 5 minutes by a double jet mixing method. After the completion of addition, the soluble salts were removed by sedimentation at 35° C. The temperature was raised to 40° C. and 100 grams of gelatin was added to the resulting emulsion, which was adjusted to pH 6.7. The emulsion contained potato-shaped grains having an average diameter of 0.82 μm calculated from the diameter of a sphere having the same volume as individual grains and a silver iodide content of 2 mol %. The emulsion was chemically sensitized with a mixture of gold and sulfur sensitizing agents.

Preparation of photosensitive material B

For forming a surface protective layer, there was used an aqueous gelatin solution which contained gelatin, polyacrylamide having an average Mw of 8,000, sodium polystyrene sulfonate, fine particulate polymethyl methacrylate having a mean particle size of 3.0 μm, polyethylene oxide, and a hardener.

To the above-prepared emulsion were added 500 mg/mol Ag of anhydro-5,5'-dichloro-9-ethyl-3,3'-di(sulfopropyl)oxacarbocyanine hydroxide sodium salt as a sensitizing dye and 200 mg/mol Ag of potassium iodide. A coating composition was prepared from the emulsion by further adding thereto 4-hydroxy-6-methyl-1,3,3a,7 tetraazaindene, 2,6-bis(hydroxyamino) -4-diethylamino-1,3,5-triazine, and nitron as stabilizing agents, trimethylol propane as a dry antifoggant, coating aids, and a hardener.

The emulsion coating composition was coated on either surface of a PET support along with the surface protective layer coating composition. The amount of silver coated was 6.4 grams/m² in total of the both sides. There was obtained photosensitive material B.

Development process

Preparation of concentrates

Developer and fixer concentrates having the following composition were prepared.

| Developer | |
|---|---|
| Part A | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriamine pentaacetic acid | 30 g |
| 1-(diethylaminoethyl)-5-mercaptotetrazole | 0.75 g |
| Hydroquinone | 450 g |
| Water | totaling to 4125 ml |
| Part B | |
| Diethylene glycol | 525 g |
| Glacial acetic acid | 102.6 g |
| 5-nitroindazole | 3.75 g |
| 1-phenyl-3-pyrazolidone | 34.5 g |
| Water | totaling to 750 ml |
| Part C | |
| Glutaraldehyde (50 wt/wt %) | 150 g |
| Sodium metabisulfite | 150 g |
| Potassium bromide | 15 g |
| Water | totaling to 750 ml |
| Fixer | |
| Ammonium thiosulfate (70 wt/vol %) | 200 ml |
| Disodium ethylenediaminetetraacetate dihydrate | 0.03 g |
| Sodium thiosulfate pentahydrate | 10 g |
| Sodium sulfite | 20 g |
| Boric acid | 4 g |
| 1-(N,N-dimethylamino)ethyl-5-mercaptotetrazole | 1 g |
| Tartaric acid | 3.2 g |
| Glacial acetic acid | 45 g |
| Sodium hydroxide | 15 g |
| Sulfuric acid (36N) | 3.9 g |
| Aluminum sulfate | 10 g |
| Water | totaling to 400 ml |
| | pH 4.68 |

Preparation of processing solutions

After preparation, developer concentrate parts A, B and C were admitted into three separate compartments integrated together as a polyethylene container.

Another polyethylene container was charged with the fixer concentrate.

The developer concentrates in the respective compartments were stored at 50° C. for 3 months before they were combined and diluted with water to prepare a developer.

Developing and fixing tanks of an automatic processor were filled with the developer and fixer in the amounts reported below by means of metering pumps built in the processor.

| Developer I | |
|---|---|
| Part A | 55 ml |
| Part B | 10 ml |
| Part C | 10 ml |
| Water | 125 ml |
| pH 10.50 | |
| Fixer | |
| Concentrate | 80 ml |
| Water | 120 ml |
| pH 4.65 | |

The wash tank was filled with city water. In the wash tank were placed four bags of non-woven fabric each containing 50 grams of a silver cation timed release agent in the form of soluble amorphous glass $Na_2O/B_2O_5/SiO_2$ (10/65/25 wt %) containing 1.7% by weight of $Ag_2O$.

Processor design

The processor used was of the following design.

| Step | Tank volume | Processing temperature | Path length | Process time (sec.) Mode (1) | Mode (2) |
|---|---|---|---|---|---|
| Develop | 15 l | 35° C.-mode (1) 32° C.-mode (2) | 613 mm | 13.3 | 24.5 |
| (solution surface area/tank volume ratio = 35 $cm^2/l$) | | | | | |
| Fix | 15 l | 32° C. | 541 mm | 11.7 | 21.6 |
| Wash | 13 l | 17° C. flowing water | 305 mm | 5.7 | 10.5 |
| Squeeze | | | | 6.6 | 12.2 |
| Drying | | 58° C. | 368 mm | 8.0 | 14.7 |
| Total | | | 1827 mm | 45.3 | 83.6 |

Processing

Using the processor of the above design filled with the predetermined volumes of the respective solutions, quarter size (10×12 inches) sheets of photosensitive material A prepared above, after X-ray exposure, were developed and processed according to mode (2) while the developer and fixer were replenished in an amount of 45 ml and 30 ml per sheet, respectively.

Wash water was fed at a flow rate of 5 l/min. for mode (2) and 10 l/min. for mode (1) (corresponding to a feed rate of about 1 liter/sheet) by opening an electromagnetic valve in a water feed line in synchronization with the duration of processing the photosensitive material. The processor was further designed (see Japanese Patent Application No. 131338/1986) such that at the end of daily operation, the wash tank was emptied of water by automatically opening the electromagnetic valve, and the crossover rollers between the developing and fixing tanks and between the fixing and washing tanks were washed by automatically spraying wash water thereto.

This is designated Run No. 1.

Run No. 1 was repeated while the type of photosensitive material, the type and amount of an antisludging agent added to the developer, the part to which the agent was added, the amount of developer replenished per sheet, and processing mode (or temperature) were changed as reported in Table 1. Each run handled 2000 sheets. At the end of each run, silver sludging and photographic properties were examined.

Silver sludging was examined by quantitatively determining the total amount (weight) of silver deposit on a single roller at a predetermined location in the developer. The silver deposit weight was reported as a relative value based on a silver weight of 10 for Run No. 1.

The photographic properties examined were sensitivity and gradation. Sensitivity is the reciprocal of an exposure required to provide a blackening degree of fog+1.0 and reported as a relative value based on a sensitivity of 100 for Run No. 1. Gradation (G) is the gradient of a straight line connecting a density of fog+0.25 and a density of fog +2.0.

The results are shown in Table 1.

TABLE 1

| Run No. | Photosensitive Material (grain type, Ag weight) | Developer: Antisludging agent | Anti-sludging Part | Amount | Replenisher amount | Mode | Silver sludging (relative value) | $\bar{G}$ | Sensitivity | Remarks |
|---|---|---|---|---|---|---|---|---|---|---|
| 1 | A (plate, 3.2 g/$m^2$) | — | — | — | 45 ml | 2 (32° C.) | 10 | 2.62 | 100 | Comparison |
| 2 | A (plate, 3.2 g/$m^2$) | — | — | — | 25 ml | 2 (32° C.) | 19 | 2.59 | 101 | Comparison |
| 3 | A (plate, 3.2 g/$m^2$) | thioctic acid | A | 0.2 g | 45 ml | 2 (32° C.) | 8 | 2.59 | 100 | Comparison |
| 4 | A (plate, 3.2 g/$m^2$) | thioctic acid | A | 0.2 g | 25 ml | 2 (32° C.) | 15 | 2.59 | 99 | Comparison |
| 5 | A (plate, 3.2 g/$m^2$) | thioctic acid | B | 0.2 g | 45 ml | 2 (32° C.) | 2 | 2.55 | 98 | Invention |
| 6 | A (plate, 3.2 g/$m^2$) | thioctic acid | B | 0.2 g | 25 ml | 2 (32° C.) | 4 | 2.57 | 97 | Invention |
| 7 | A (plate, 3.2 g/$m^2$) | I-15*1) | A | 0.2 g | 45 ml | 2 (32° C.) | 7 | 2.60 | 101 | Comparison |
| 8 | A (plate, 3.2 g/$m^2$) | I-15 | A | 0.2 g | 25 ml | 2 (32° C.) | 14 | 2.59 | 100 | Comparison |
| 9 | A (plate, 3.2 g/$m^2$) | I-15 | B | 0.2 g | 45 ml | 2 (32° C.) | 1 | 2.57 | 99 | Invention |
| 10 | A (plate, 3.2 g/$m^2$) | I-15 | B | 0.2 g | 25 ml | 2 (32° C.) | 1 | 2.58 | 98 | Invention |
| 11 | A (plate, 3.2 g/$m^2$) | II-1<br>III-1 | A | 0.1 g<br>0.165 g | 45 ml | 2 (32° C.) | 10 | 2.57 | 101 | Comparison |
| 12 | A (plate, 3.2 g/$m^2$) | II-1<br>III-1 | A | 0.1 g<br>0.165 g | 25 ml | 2 (32° C.) | 11 | 2.58 | 100 | Comparison |
| 13 | A (plate, 3.2 g/$m^2$) | II-1<br>III-1 | B | 0.1 g<br>0.165 g | 45 ml | 2 (32° C.) | 3 | 2.56 | 98 | Invention |
| 14 | A (plate, 3.2 g/$m^2$) | II-1<br>III-1 | B | 0.1 g<br>0.165 g | 25 ml | 2 (32° C.) | 6 | 2.57 | 99 | Invention |
| 15 | A (plate, 3.2 g/$m^2$) | L*2) | A | 0.288 g | 25 ml | 2 (32° C.) | 15 | 2.55 | 42 | Comparison |
| 16 | A (plate, 3.2 g/$m^2$) | L | A | 0.288 g | 45 ml | 2 (32° C.) | 8 | 2.53 | 38 | Comparison |
| 17 | A (plate, 3.2 g/$m^2$) | L | B | 0.288 g | 25 ml | 2 (32° C.) | 16 | 2.54 | 41 | Comparison |
| 18 | A (plate, 3.2 g/$m^2$) | L | B | 0.288 g | 45 ml | 2 (32° C.) | 8 | 2.49 | 40 | Comparison |
| 19 | A (plate, 3.2 g/$m^2$) | L | C | 0.288 g | 25 ml | 2 (32° C.) | 15 | 2.51 | 42 | Comparison |
| 20 | A (plate, 3.2 g/$m^2$) | L | C | 0.288 g | 45 ml | 2 (32° C.) | 8 | 2.50 | 40 | Comparison |
| 21 | A (plate, 3.2 g/$m^2$) | II-2<br>III-2 | B | 0.2 g<br>0.4 g | 25 ml | 2 (32° C.) | 12 | 2.61 | 102 | Invention |
| 22 | A (plate, 3.2 g/$m^2$) | — | — | — | 25 ml | 1 (32° C.) | 15 | 2.63 | 101 | Comparison |
| 23 | A (plate, 3.2 g/$m^2$) | thioctic acid | B | 0.2 g | 25 ml | 1 (32° C.) | 3 | 2.57 | 98 | Invention |
| 24 | A (plate, 3.2 g/$m^2$) | I-15 | B | 0.2 g | 25 ml | 1 (32° C.) | 1 | 2.58 | 98 | Invention |
| 25 | A (plate, 3.2 g/$m^2$) | I-28 | B | 0.2 g | 25 ml | 1 (32° C.) | 2 | 2.55 | 97 | Invention |
| 26 | A (plate, 3.2 g/$m^2$) | II-1<br>III-1 | B | 0.1 g<br>0.165 g | 25 ml | 1 (32° C.) | 5 | 2.58 | 97 | Invention |
| 27 | B (Potato, 6.4 g/$m^2$) | — | — | — | 25 ml | 2 (32° C.) | 17 | 2.54 | 100 | Comparison |
| 28 | B (Potato, 6.4 g/$m^2$) | — | — | — | 45 ml | 2 (32° C.) | 9 | 2.48 | 95 | Comparison |
| 29 | B (Potato, 6.4 g/$m^2$) | thioctic acid | A | 0.2 g | 25 ml | 2 (32° C.) | 14 | 2.50 | 98 | Comparison |
| 30 | B (Potato, 6.4 g/$m^2$) | thioctic acid | A | 0.2 g | 45 ml | 2 (32° C.) | 7 | 2.52 | 99 | Comparison |
| 31 | B (Potato, 6.4 g/$m^2$) | thioctic acid | B | 0.2 g | 25 ml | 2 (32° C.) | 4 | 2.45 | 96 | Invention |
| 32 | B (Potato, 6.4 g/$m^2$) | thioctic acid | B | 0.2 g | 45 ml | 2 (32° C.) | 2 | 2.46 | 97 | Invention |
| 33 | B (Potato, 6.4 g/$m^2$) | I-15 | A | 0.2 g | 25 ml | 2 (32° C.) | 13 | 2.46 | 101 | Comparison |

TABLE 1-continued

| Run No. | Photosensitive Material (grain type, Ag weight) | Developer: Antisludging agent | Developer: Anti-sludging Part | Developer: Amount | Developer: Replenisher amount | Developer: Mode | Silver sludging (relative value) | $\bar{G}$ | Sensitivity | Remarks |
|---|---|---|---|---|---|---|---|---|---|---|
| 34 | B (Potato, 6.4 g/m$^2$) | I-15 | A | 0.2 g | 45 ml | 2 (32° C.) | 7 | 2.49 | 100 | Comparison |
| 35 | B (Potato, 6.4 g/m$^2$) | I-15 | B | 0.2 g | 25 ml | 2 (32° C.) | 1 | 2.47 | 97 | Invention |
| 36 | B (Potato, 6.4 g/m$^2$) | I-15 | B | 0.2 g | 45 ml | 2 (32° C.) | 1 | 2.45 | 98 | Invention |
| 37 | B (Potato, 6.4 g/m$^2$) | II-1<br>III-1 | A | 0.1 g<br>0.165 g | 25 ml | 2 (32° C.) | 9 | 2.52 | 101 | Comparison |
| 38 | B (Potato, 6.4 g/m$^2$) | II-1<br>III-1 | B | 0.1 g<br>0.165 g | 25 ml | 2 (32° C.) | 6 | 2.50 | 97 | Invention |
| 39 | B (Potato, 6.4 g/m$^2$) | L | A | 0.288 g | 25 ml | 2 (32° C.) | 15 | 2.45 | 41 | Comparison |
| 40 | B (Potato, 6.4 g/m$^2$) | L | B | 0.288 g | 25 ml | 2 (32° C.) | 15 | 2.40 | 38 | Comparison |

*1)I-15: the same compound as described in JP-B 46585/1981
*2)L: compound described in JP-A 24347/1981 (JP-B 4702/1987)

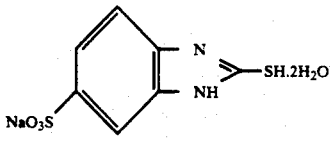

When processing according to JP-B 46585/1981 using compound I-15, silver sludge suppression was achieved only to such an extent as achieved by adding the same compound to Part A (as reported in Table 1).

When processing according to JP-A 209455/1987 using thioctic acid, silver sludge suppression was achieved only to such an extent as achieved by adding the same compound to Part A (as reported in Table 1).

EXAMPLE 2

Instead of the photosensitive material used in Example 1, medical radiographic photosensitive materials Super HR-S, Super HR-A, Super HR-L, and Super HR-C manufactured by Fuji Photo-Film Co., Ltd. in a sheet number proportion of 8:1:1:1 were similarly processed on a running basis and in a total daily quantity of 150 sheets.

The developer used in this example had the following composition.

| Developer | |
|---|---|
| Part D | |
| Sodium hydroxide | 8 g |
| Potassium sulfite | 75 g |
| Potassium carbonate | 10 g |
| Boric acid | 5 g |
| Diethylene glycol | 20 g |
| Diethylenetriamine pentaacetic acid | 2 g |
| 5-methylbenzotriazole | 0.075 g |
| Hydroquinone | 25 g |
| 4-hydroxymethyl-4-methyl-3-pyrazolidone | 3 g |
| Sodium bromide | 3 g |
| Water | totaling to 400 ml |
| Part E | |
| 5-nitroindazole | 0.12 g |
| Glutaraldehyde (50 wt/wt %) | 10 g |

After preparation, developer concentrate parts D and E were admitted into two separate compartments of a container. The developer concentrates in the respective compartments were stored at 50° C. for 3 month. Thereafter, 40 ml of Part D and 10 ml of Part E were combined and diluted with 590 ml of water to prepare a developer.

Using the processor of the above design filled with the predetermined volumes of the respective solutions, the sheets of photosensitive material were developed and processed on a running basis over 3 months according to mode (2), but at 35° C. while the developer and fixer were replenished in an amount of 30 ml and 30 ml per sheet, respectively.

This is designated Run No. 201.

Run No. 201 was repeated except that thioctic acid or compound (I-15) was added to either Part D or E as reported in Table 2. At the end of each run, silver sludging was examined as in Example 1.

The results are shown in Table 2.

TABLE 2

| Run | Developer: Compound | Developer: Part | Developer: Amount | Silver sludge | Remarks |
|---|---|---|---|---|---|
| 201 | — | — | | 16 | Comparison |
| 202 | thioctic acid | D | 0.2 g | 13 | Comparison |
| 203 | thioctic acid | E | 0.2 g | 3 | Invention |
| 204 | I-15 | D | 0.2 g | 10 | Comparison |
| 205 | I-15 | E | 0.2 g | 1 | Invention |

The present invention avoids any lowering of anti-silver-sludging ability of a developer composition during shelf storage so that a developer prepared from the composition is effective to alleviate silver sludging occurring in the developing tank and/or on the developing rack and rollers of an automatic processor or developing equipment, ensuring easy maintenance of the processor or developing equipment. The developer is stable and effective in photographic properties. The benefits of the invention become more outstanding upon processing with a smaller amount of developer replenished or upon processing photo-sensitive materials having an increased silver coating weight.

Although some preferred embodiments have been described, many modifications and variations may be made thereto in the light of the above teachings. It is therefore to be understood that within the scope of the appended claims, the invention may be practiced otherwise than as specifically described.

We claim:

1. A developer composition for preparing a developer for the development of photographic silver halide photosensitive material, comprising a dihydroxybenezene developing agent, a sulfite ion, and an antisludging agent selected from the group consisting of (A) thioctic acid or a salt thereof, (B) a compound of general formula (I):

$$(A_2)_m—B_1—S—(S)_p—D_1—(E_2)_n \quad (I)$$

wherein $B_1$ and $D_1$ are independently selected from the group consisting of an aliphatic hydrocarbon radical, an alicyclic hydrocarbon radical, an aromatic hydrocarbon radical, and a heterocyclic radical, $A_2$ and $E_2$ are independently selected from the group consisting of —COOM and —$SO_2$—OM—SO wherein M is a monovalent cation, m and n each are equal to 1, 2 or 3, p is equal to 1 to 2, with the proviso that $B_1$ and $D_2$ are free of an α-amino radical when at least one of $A_2$ and $E_2$ is a radical represented by —COOM, or a salt thereof, (C) a combination of Y1) a compound of general formula (II):

$$R-\underset{}{\overset{SH}{\overset{|}{C}}}HCH_2-COOH \qquad (II)$$

wherein R is a phenyl or alkyl radical, or salt thereof and (Y2) a compound of general formula (III):

$$R'-\overset{S-SO_3M'}{\overset{|}{C}}HCH_2-COOH \qquad (III)$$

wherein R' is a phenyl or alkyl radical and M' is a hydrogen atom or alkali metal, an aminoalkanethiosulfonic acid or a salt thereof, and mixtures thereof, wherein the developer composition is divided into a plurality of parts, which are combined together to form the developer composition, and said antisludging agent is added to one of the plurality of parts which is substantially free of said sulfite ion coexisting with said dihydroxybenzene developing agent.

2. The developer composition of claim 1, wherein the developer composition is divided into two parts, one part containing the dihydroxybenzene developing agent and the sulfite ion as a preservative and the other parts containing a hardener and the antisludging agent.

3. The developer composition of claim 1, wherein the composition is divided into three parts, a first part containing the dihydroxybenzene developing agent and the sulfite ion, a second part containing an auxiliary developing agent, and a third part containing a hardener, the antisludging agent being added to either one or both of the second and third parts.

4. The developer composition of any one of claim 1, 2 and 3, wherein the part to which the antisludging agent is added is acidic.

5. The developer composition of any one of claims 1, 2 and 3, wherein the antisludging agent is added in an amount to provide a concentration of 0.01 to 20 grams of the agent per liter of the developer which is prepared by combining the parts and diluting with water.

6. A developer composition for preparing a developer for the development of photographic silver halide photosensitive material, comprising a dihydroxybenzene developing agent, a sulfite ion, and an antisludging agent selected from the group consisting of (A) thioctic acid or a salt thereof, (B) a compound of general formula (I):

$$(A_2)_m-B_1-S-(S)_p-D_1-(E_2)_n \qquad (I)$$

wherein $B_1$ and $D_1$ are independently selected from the group consisting of an aliphatic hydrocarbon radical, an alicyclic hydrocarbon radical, an aromatic hydrocarbon radical, and a heterocyclic radical, $A_2$ and $E_2$ are independently selected from the group consisting —COOM and —$SO_2$—$OM_1$ —SO wherein M is a monovalent cation, m and n each are equal to 1, 2 or 3, p is equal to 1 or 2, with the proviso that $B_1$ and $D_1$ are free of an α-amino radical when at least one of $A_2$ and $E_2$ is a radical represented by —COOM, or a salt thereof, (C) a combination of (y1) a compound of general formula (II):

$$R-\overset{SH}{\overset{|}{C}}HCH_2-COOH \qquad (II)$$

wherein R is a phenyl or alkyl radical, or salt thereof and (Y2) a compound of general formula (III):

$$R'-\overset{S-SO_3M'}{\overset{|}{C}}HCH_2-COOH \qquad (III)$$

wherein R' is a phenyl or alkyl radical and M' is a hydrogen atom or alkali metal, an aminoalkanethiosulfonic acid or a salt thereof, and mixtures thereof, wherein the developer composition is divided into a plurality of parts, which are combined together to form the developer composition and, said antisludging agent is added to one of the plurality of parts which is substantially free of said dihydroxybenzene developing agent.

* * * * *